US009053685B2

(12) United States Patent
Spinazzola et al.

(10) Patent No.: US 9,053,685 B2
(45) Date of Patent: Jun. 9, 2015

(54) ONE TOUCH DRUM TUNING COMPONENTS

(71) Applicants: David Michael Spinazzola, Sammamish, WA (US); Joseph André Penaranda, Renton, WA (US)

(72) Inventors: David Michael Spinazzola, Sammamish, WA (US); Joseph André Penaranda, Renton, WA (US)

(73) Assignee: Rotek Drum Systems, Inc., Sammamish, WA (US)

( * ) Notice: Subject to any disclaimer, the term of this patent is extended or adjusted under 35 U.S.C. 154(b) by 0 days.

(21) Appl. No.: 13/891,090

(22) Filed: May 9, 2013

(65) Prior Publication Data

US 2014/0053708 A1 Feb. 27, 2014

Related U.S. Application Data

(60) Provisional application No. 61/645,337, filed on May 10, 2012.

(51) Int. Cl.
*G10D 13/02* (2006.01)

(52) U.S. Cl.
CPC ..... *G10D 13/023* (2013.01)

(58) Field of Classification Search
CPC ..... G10D 13/023
USPC ..... 84/413
See application file for complete search history.

(56) References Cited

U.S. PATENT DOCUMENTS

| | | | | | |
|---|---|---|---|---|---|
| 388,771 | A * | 8/1888 | Fleck | 84/411 R |
| 793,399 | A * | 6/1905 | Schultz | 84/411 R |
| 1,901,765 | A * | 3/1933 | Newberry | 84/411 R |
| 2,173,443 | A * | 9/1939 | Schuman | 84/411 R |
| 3,439,573 | A * | 4/1969 | Zottolo | 84/411 R |
| 4,079,657 | A * | 3/1978 | Sobreira | 84/411 R |
| 4,869,146 | A * | 9/1989 | Bonsor | 84/413 |
| 5,410,938 | A * | 5/1995 | Kurosaki et al. | 84/411 R |
| 5,447,087 | A * | 9/1995 | Hawes et al. | 84/413 |
| 5,739,448 | A * | 4/1998 | Toscano | 84/413 |
| 5,841,049 | A * | 11/1998 | Strawn | 84/411 R |
| 6,417,432 | B1 * | 7/2002 | Downing | 84/411 R |
| 7,138,574 | B1 * | 11/2006 | Spinazzola | 84/411 R |
| 7,501,567 | B1 * | 3/2009 | Spinazzola | 84/411 R |
| 8,629,340 | B1 * | 1/2014 | Martin | 84/411 R |
| 8,642,867 | B1 * | 2/2014 | Bedson | 84/413 |
| 2014/0026732 | A1 * | 1/2014 | Spinazzola | 84/413 |
| 2014/0053708 | A1 * | 2/2014 | Spinazzola et al. | 84/413 |
| 2015/0027295 | A1 * | 1/2015 | Bedson | 84/413 |

* cited by examiner

*Primary Examiner* — Robert W Horn

(74) *Attorney, Agent, or Firm* — Richard T. Black; Foster Pepper PLLC

(57) ABSTRACT

Methods and devices for attaching a one touch tuning system to different drum types. Components preferably include a retrofit ring for fitting the one touch tuning system to a lug style drum, and elevators to attach and adjust the height of the tuning system on the drum. On full floating drums, a framework is provided so that no hardware need be attached to the drum's shell. Framework may also include adjustable pull rods which can attach a tuning system on one end of the drum to another tuning system on the opposite end. Twisting the adjustable pull rods one direction extends the length of them, twisting the opposite direction retracts them thereby shortening the overall length of the framework in relation to the depth of the drum shell. Offset rim rollers help align the inner hoop and rotating actuator rings to offer more precise tuning and free movement.

5 Claims, 6 Drawing Sheets

ONE TOUCH DRUM TUNING COMPONENTS

PRIORITY CLAIM

This application claims the benefit of the filing date of U.S. Patent Application No. 61/645,337, filed May 10, 2012, entitled "ROTATION ACTIVATED ACOUSTIC DRUM TUNING SYSTEM."

BACKGROUND OF THE INVENTION

Embodiments of the present invention relate to a novel and/or useful system and apparatus for tuning any acoustic drum. Drums are comprised of several simple components including a drum head, most commonly made of a plastic material called Mylar, which include a rigid rim, generally made of a metallic material. The drum shell; most often made of layers of laminated wood, acrylic, aluminum, fiberglass or carbon fiber and/or formed to a cylindrical shape with two open ends. The drum head is stretched over the drum shell by means of a multiplicity of evenly spaced bolts inserted through holes around the diameter of a ring often made of stamped steel, die cast zinc, aluminum or wood known as the hoop. These bolts are threaded into what are commonly referred to as lugs which are generally attached to the drum shell by bolts inserted through holes drilled into the drum shell. Evenly adjusting the tension of these individual bolts causes the drum head to be tuned either higher or lower in pitch.

The current and/or most commonly used standard for tuning drums is best depicted by U.S. Design Pat. Fuji D350,362, incorporated by reference herein. Referred to as the drum hoop, it includes a plurality of evenly spaced holes for bolts to be inserted through, in order to exert tension on the drum head, and having an overall shape designed to fit over the drum head. U.S. Design Pat. D339,818, incorporated by reference herein, is an example of lugs which are fastened to the drum shell and/or serve as anchors for the bolts inserted through the drum hoop previously described. Some of the earliest designs of this current hoop can be seen in U.S. Pat. No. 794,658 dated Jul. 11, 1905, incorporated by reference herein, which depicts a combination of L cross section or "angle iron" rings, one with the vertical with surface facing upward, the other overlapping the horizontal surface and/or its vertical surface facing downward with holes about the horizontal flange for clamping down the drumhead. Similarly, U.S. Pat. No. 899,488 dated Sep. 22, 1908 has an inverted U shaped Cross Section with evenly spaced holes around its perimeter. One of the first early modern designs is shown in U.S. Pat. No. 1,609,940 dated Dec. 7, 1926, which appears to feature a one piece counterhoop having an "L" cross section, the horizontal flange having evenly spaced holes for clamping the drum head to the open end of the drum shell. U.S. Pat. No. 6,166,311 describes an invention that was designed as an improvement to the traditional drum hoop, having an inward facing horizontal annular surface at the top of the hoop that provides protection to the bearing edge of the drum shell, and also increases rigidity of the drum hoop.

Using traditional drum hoops and methods, to evenly apply tension to the drum head to set the correct pitch takes a great amount of time and skill, often being time consuming and frustrating. To deal with this problem, systems for tuning drums have been proposed simplify this common task. For example, U.S. Pat. No. 4,218,952 is comprised of a large counter-hoop with a plurality of inward facing slides angled to act as ramps which ride on rollers or matching opposing slides fastened to the drum shell. It is tuned by rotating the counter-hoop clockwise or counterclockwise using a rack and pinion activation system. U.S. Pat. No. 5,739,448 is comprised of an inverted J-shaped counter-hoop, which engages an externally threaded, outwardly facing tuning rim surface on a tuning collar that is secured to the drum shell. Clockwise or counterclockwise rotation of the counter-hoop is accomplished by a pair of gears, one for gross tuning, and/or one for fine tuning.

US patent describes the undersigned inventor's improvement over U.S. Pat. No. 4,218,952. The system and apparatus described U.S. Pat. No. 6,043,419 utilizes a V Clamping mechanism which engages a counter-hoop which has a downwardly and outwardly extending flange which bears on the drum head and a flanged ring fastened to the drum shell, its flange portion inclined upwards and outwards. The V clamp ring surrounds the drum shell and engages the outwardly extending portions of the counter-hoop, and the shell hoop. The V hoop contains a breach, tightening a bolt connecting the breached area draws the two hoops together and applies tension to the drum head.

U.S. Pat. No. 7,777,112 uses an outer ring attached to the drum shell with threads on the inner diameter. An inner ring which has a thread on the outside diameter engages the outer ring's threads. A lower inner ring which is separated by ball bearings rides on the rim of the drum head. Rotating the inner ring increases or decreases the tension on the drum head.

One of the undersigned inventor's first solution to simplifying tuning was described in U.S. Pat. No. 7,138,574, incorporated by reference herein. This '574 drum tuning system is comprised of three annular members o-rings. The first annular member is the cam ring which utilizes a single spiraling track or helical around its outside diameter starting at the top of the spiral cam ring spiraling down and exiting at the bottom and is fastened to the cylindrical drum shell in the vicinity near the opened end of the drum shell. The second ring is a smaller inner counter-hoop having vertical and horizontal surfaces which form an L cross section. The third ring is a larger outer rotating actuator ring has inward facing horizontal surface atop the vertical surface forming an inverted L cross section and encompasses the spiral cam ring parallel to the spiral track or helical at its outside diameter. Inward facing rollers or wheels mounted on its vertical surface of the inside diameter engages the track or helical of the cam ring. The rotating actuator's inverted L cross section overlaps the L cross section of the inner counter-hoop, and the two rings are separated by bearings or rollers to reduce friction while twisting the rotating actuator ring clockwise or counterclockwise. The camming effect increases or decreases the downward force on the inner counter-hoop which bears down on the outer rim of the drum head when fitted over the open end of the drum shell, thereby tuning the drum. Embodiments of the invention described in '574 mainly focused on certain mechanical aspects of altering the tension of a drum head efficiently and/or accurately.

One of the undersigned inventor's second U.S. Pat. No. 7,501,567, incorporated by reference herein, had many improvements which included a method for attaching the tuning system to a drum shell and used eccentrics on the lugs to raise and/or lower the cam ring. Another improvement was the addition of a horizontal radius plate with holes for a drum stick to engage and/or be used as a leverage point stationary in relation to the drum shell. A tool was devised which hooked on "cleats" mounted on the lower vertical walls of the rotation actuator ring. A drum stick can be used for leverage against the tool while engaging the holes in the stationary radius plate and thereby facilitates movement of the rotating actuator ring, which in turn tunes the drum. The inner hoop and rotating actuator ring are completely separate. The rotating actuator ring has vertical bosses with inward facing rim rollers which ride on the horizontal surface of the inner hoop. A mounting system for mounting the drum in a stand used horizontal bolts and/or rubber grommets to allow for maximum resonance.

DETAILED DESCRIPTION

Figure 1:
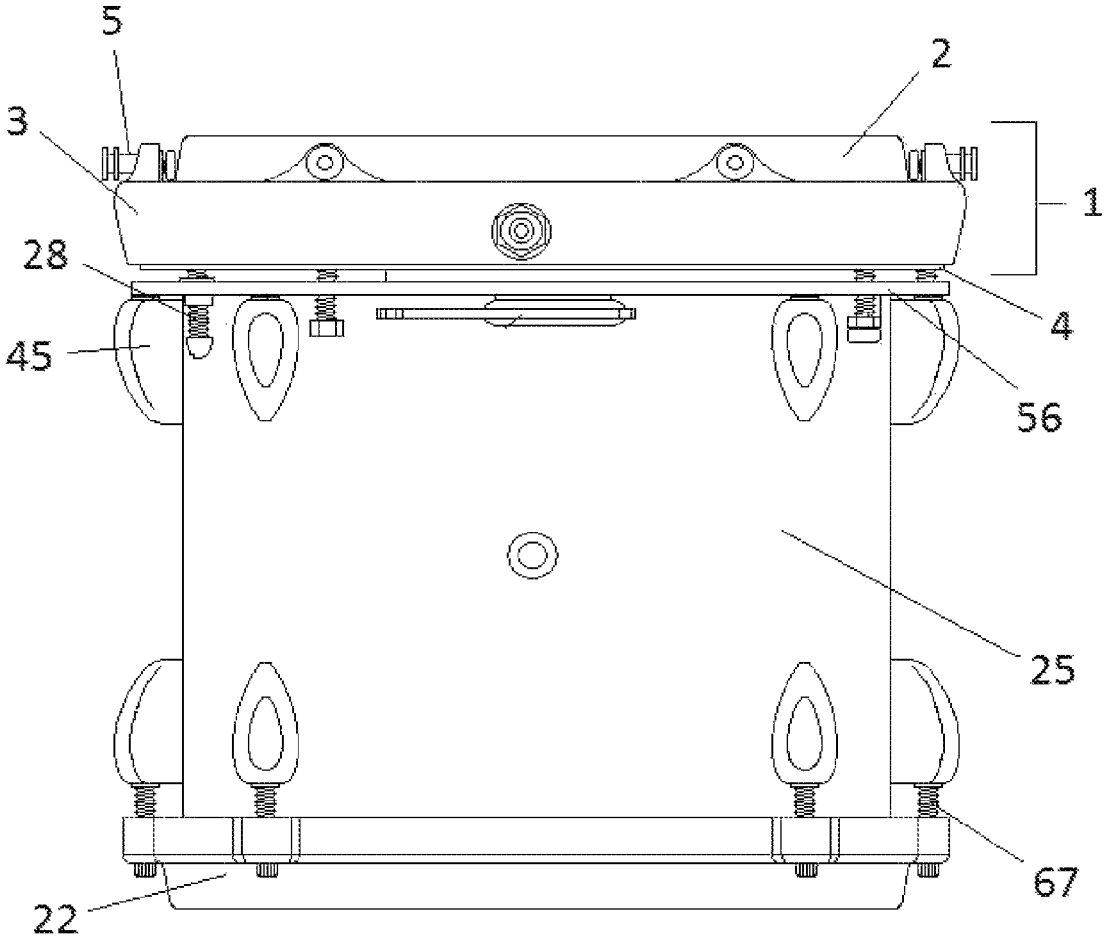
FIG. 1 is a side view of a standard lug style drum with a one touch tuning system adapted to the drum using a retrofit ring and elevator bolts.

The drum in FIG. 1 is a standard lug type drum with a one touch tuning system retrofitted to the top side of the drum. A horizontal flange or retrofit ring 56 has a multiplicity of holes which match the bolt circle 43 (see FIG. 2), the number of holes, and the clocking or positioning of the drum's lugs. A second multiplicity of holes 64 (see FIG. 2) allow for elevators 28 to be used to attach and adjust the height of the Cam Ring 4 from the one touch tuning system 1. The different sets of holes may or may not be of the same bolt circle diameters or quantities, which allows for attaching tuning systems 1 to any brand of drums. The ring 56 is like a large washer, preferably having sufficient thickness so that it does not flex or bend when the drum is tuned. To install, first remove the standard drum hoop 22 and drum head. To install, the user would next, place the horizontal retrofit ring 56 atop the lugs 45 on the drum and align the holes in the retrofit ring 56 with the holes in the lugs 45 on the drum. Then the user would bolt down the retrofit ring to the drum lugs. Next, the user would fit the one touch tuning system's 1 Cam Ring 4 to the horizontal retrofit ring 56, and use of the elevator systems shown in FIG. 5 to mount and adjust the height of the cam ring 4 until the desired distance is set in relation to the open end of the drum's bearing edge. The user would then place a drum head on the bearing edge of the drum shell 25, then the inner hoop 2, and then the rotator ring 3. To tune the drum, the user would spin the rotator ring 3 clockwise until the desired pitch is attained.

Figure 2:
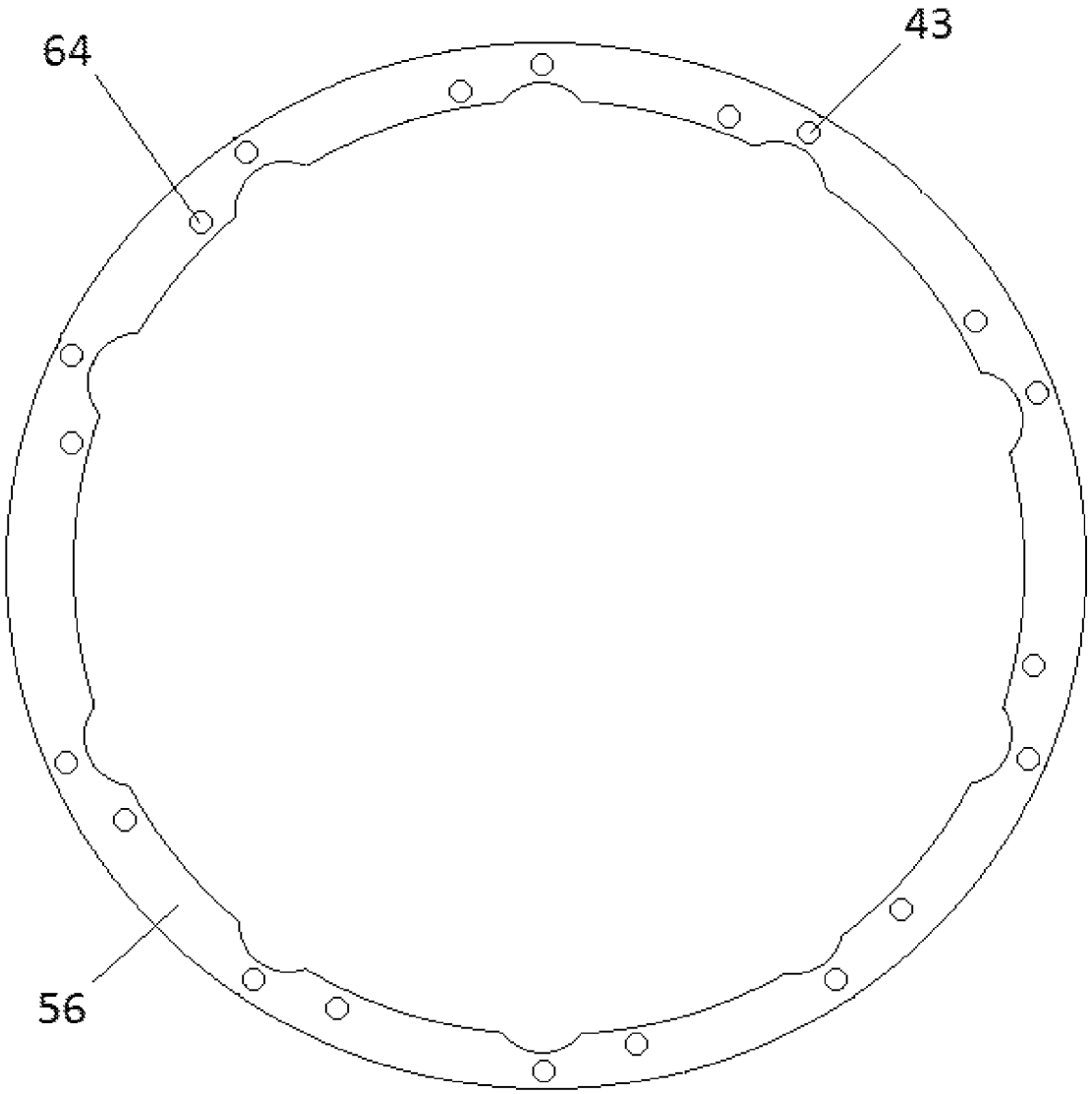
FIG. 2 is a top view of a retrofit ring used to adapt a one touch tuning system to a lug based drum, and illustrates scallops for clearance for each lug and two different sets of holes, one that matches the bolt circle of the drum and the other to match the tuning system.

FIG. 2 shows a plan view of the preferred embodiment of the retrofit ring 56 with two sets of evenly spaced holes, one set of holes to connect to the drum lugs 45 and the other set of holes to connect the one touch tuning system FIG. 1 reference character 1. The retrofit ring 56 is sufficiently rigid so that it will not flex so that it will provide a stable surface for the one touch tuning system FIG. 1 reference character 1.

Figure 3:
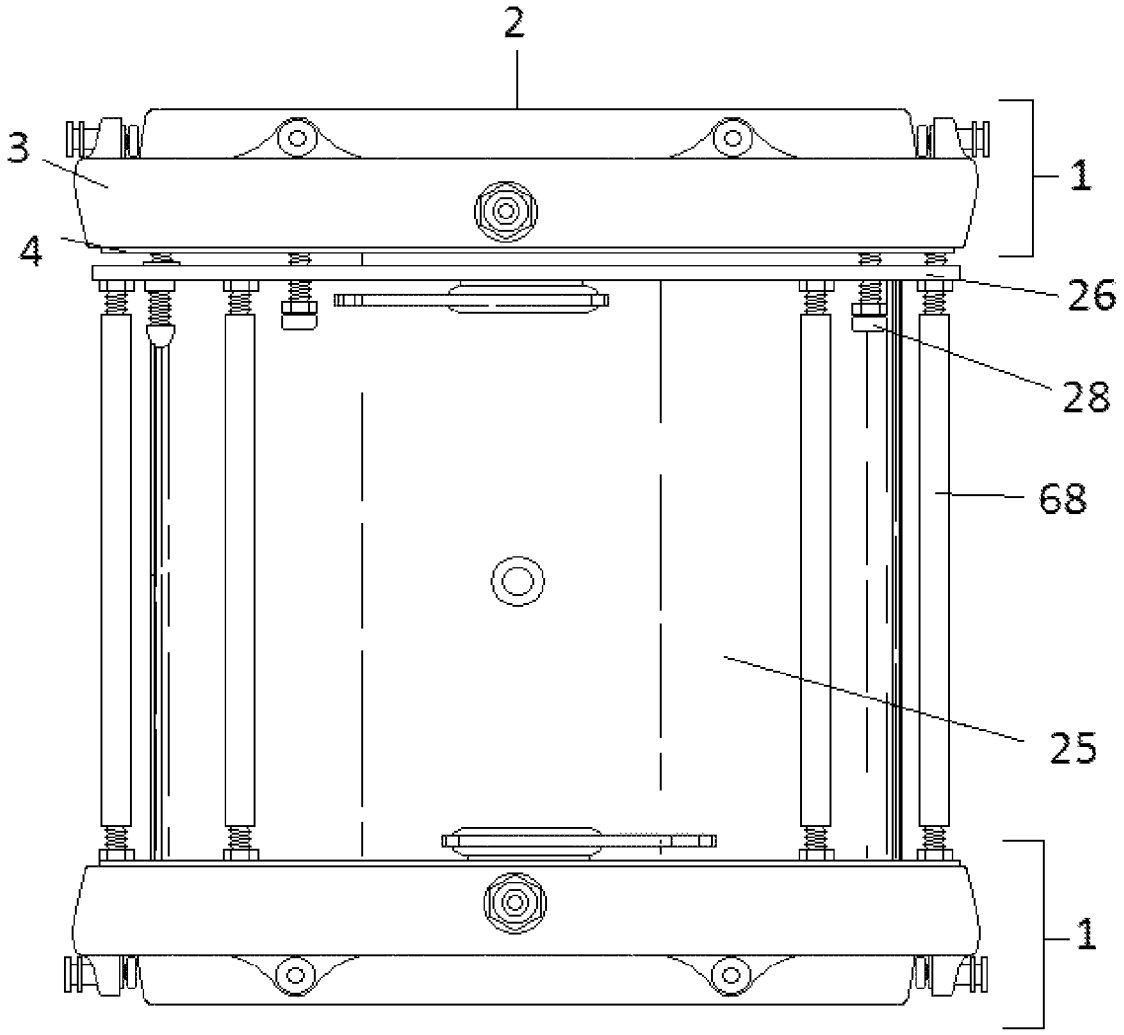
FIG. 3 is a side view of a full floating drum which has a one touch drum tuning system mounted on each end of the drop which illustrates the full floating framework enclosing a drum shell between the open ends of a drum so that no hardware is connected to the drum shell.
Figure 5:
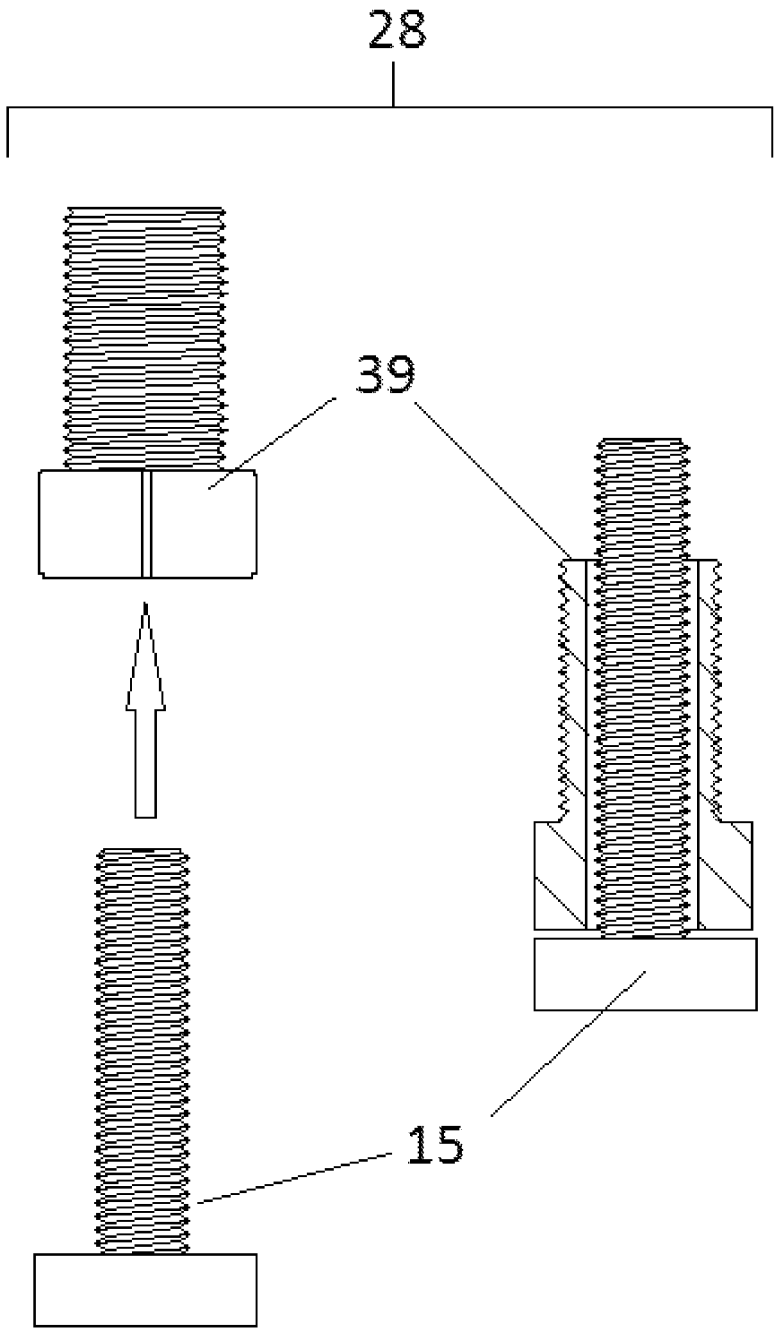
FIG. 5 is a cross sectional view of an elevator system used to attach a one touch drum tuning system to a retrofit ring or intermediate ring.

The full floater drum shown assembled in FIG. 3 is comprised of a framework in which the drum shell does not have any hardware bolted to it. The framework employs an edge ring or flange ring 26 or having both vertical and horizontal surfaces, giving it an "L" cross section. The vertical walls of the flange ring 26 act as a primary drum shell, and the horizontal wall acts as the anchor point for adjustable pull rods 68. The one touch tuning system's cam ring 4 is attached to the flange ring 26 via adjustable elevators (FIG. 5). A plurality of adjustable pull rods 68 are used to connect the edge ring to a second tuning system's cam ring 4 near the opposite open end of the drum shell 25. These pull rods have a standard thread on one end, and a reverse thread on the other. Twisting these pull rods clockwise or counterclockwise raises or lowers said one touch tuning system 1 axially in relation to the open end of the drum shell 25. On the bottom, the drum shell 25 is slipped through the second tuning system's Cam Ring 4 surrounded by the Adjustable Pull Rods 68 until the shell contacts the underside of the flange ring 26. The use of the flange ring 26 separates the tuning mounted at opposite ends of the drum. Fully assembled, one end of the drum shell 25 contacts the underside of the horizontal surface of the flange ring 26, the drum head is stretched over the open end of the drum shell's 25 bearing edge 12 by the one touch tuning system. On the top, a drum head is fitted over the bearing edge of the flange ring 26, the Inner Hoop 2 is placed over the drum head, and the Rotating Actuator 3 is placed over the Inner Hoop 2. Clockwise and counterclockwise movement of the Rotating Actuator 3 raises and lowers the pitch of the drum.

Figure 4:
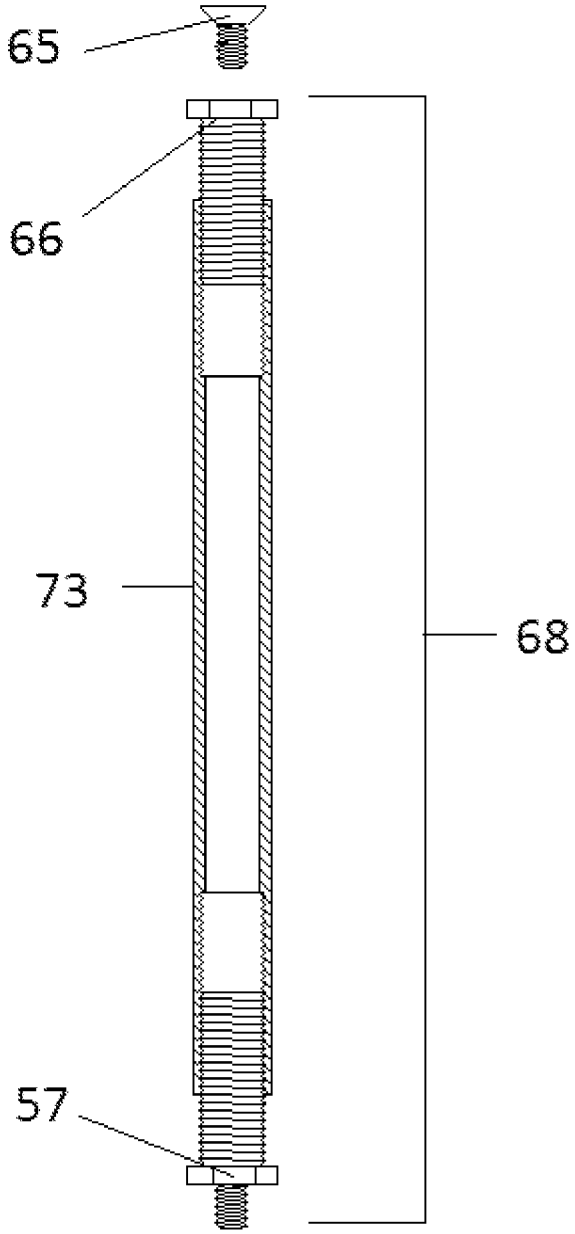
FIG. 4 is a cross sectional view of an adjustable full floater rod used to connect the top and bottom one touch tuning systems on a musical drum.

The pull rod FIG. 4 is adjustable due to variations of drum shell 25 depths and drum head 23 profiles at the crown. The adjustable pull rod 68 uses a standard female thread on one end 60, and a reverse female thread 61 on the opposite end. Turning the rod or tube 73 against the standard thread studs 66 and the reverse thread stud 57 cause the overall length of the pull rod to be shortened or lengthened.

In order to attach the one touch drum tuning system to a drum, sometimes an intermediate ring is preferable, such as the retrofit ring as in FIG. 2 for a lug style drum, or an intermediate flange ring as in FIG. 3 reference character 26 for a full floating drum shown in FIG. 3. The elevator system FIG. 5 uses a plurality of hollow tubular nuts or hollow bolts 39 with threads on the outside and a hex head or knurling for adjustment. A standard bolt 15 is inserted through the hollow of the tubular nut/hollow bolt 39 and left finger tight. The elevator would be threaded into a retrofit ring FIG. 2 reference character 56 or a flange ring on a full floater drum FIG. 3 reference character 26. Turning the tubular nut/hollow bolts 39 clockwise or counterclockwise raises and lowers the cam ring until the desired distance from the drum shell's bearing edge is achieved, then the bolt 15 is locked down to prevent loss of adjustment.

Figure 6:
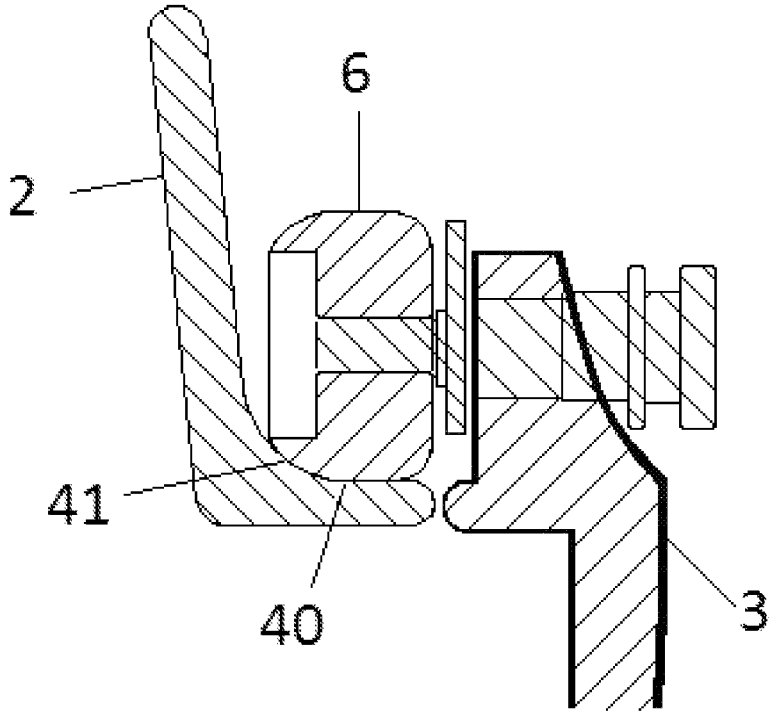
FIG. 6 is a cross sectional view of an offset roller mounted on an axle which is used on a one touch drum tuning system which illustrates an offset roller that matches the profile of the inner hoop at the vertical and horizontal axis and aids in aligning the rotator ring and the inner hoop.

The rim roller FIG. 6 is attached to an axle which is fastened to the one touch tuning systems rotating actuator 3. To help align the rotating actuator 3 and inner hoop 2 and provide for smooth operation of the tuning system 1, an offset rim roller FIG. 6 was devised to match the profile of the inner hoop 2 at the axis where the vertical wall 41 and horizontal walls 40 meet. This provides for ideal spacing between the outside diameter of the Inner Hoop 2 and inside diameter of the Rotating Actuator ring 3. A cross section view of the offset roller 6 illustrates an oblong wheel, one side having a smaller radius, the other having a larger radius. The offset or oblong roller 6 contacts the vertical surface 41 of the Inner Hoop 2 and acts as a guide, while the horizontal surface 40 of the offset roller 6 bears the load when the drums are tuned.

Embodiments of the present invention include improvements made to U.S. Pat. Nos. 7,138,574 and 7,501,567 through real world testing with professional touring drummers and continued R&D. Embodiments of the present invention address several key issues; adaptability to existing drums, adjustability range, the ease of use.

Adaptability of the one touch tuning system is the advantageous for successful adoption of the technology. Embodiments of the present invention facilitate ease of installation and retaining the appearance of the drums when originally purchased while enhancing the ease of use and sound quality. The components in this application were devised to facilitate broadening the market that the one touch tuning system can be fit to, including both new and existing drums.

There are essentially two types of drum configurations being used on acoustic drums. First are drums which use lugs bolted to the shell of the drum to tension the drum heads, and second are full floating drums where the shell is enclosed between the open ends of the drum and have little or no hardware touching the drum shell. In order to facilitate fitting the one touch tuning systems to drums, components were developed to aid in adjustment and attachment and smooth operation.

To fit the one touch tuning systems to drums, an elevator system was developed which allowed for attachment and adjustability. The elevator system is comprised of a hollow tubular nut which is threaded on the outside with a standard bolt through the middle of it. The hollow nut is elongate and has a hex or knurled surface to spin the nut on one end so that it can be threaded into an intermediate ring or retrofit ring. The bolt is then threaded into the cam ring of the one touch tuning system but left finger tight. The longer threaded section of the hollow nut allows for a full range of adjustment to raise or lower the one touch cam ring. As the hollow nuts are moved, the cam height can be precisely set in relation to the open end of the drum shell. Once set, the bolt is fully tightened so that it will not go out of adjustment. Due to different brands of drums heads and shell depths, the ability to position the one touch tuning system is very advantageous.

Because there are literally millions of drum sets worldwide that can benefit from the one touch tuning system, a retrofit system has been designed to allow the system to be installed on drums made by most any manufacturer. Without replacing the lugs which come standard on the existing drums, a retrofit ring is bolted to the top of the drum lugs where the old tension rods and counter-hoop used to be located and used for tensioning/tuning the drum. The retrofit ring is larger in diameter than the drum shell, and has two different bolt circles because the one touch tuning system might have a different bolt circle diameter, or a different number of bolts. For example, a drum might have 6 lugs and the tuning system 8 holes. In either case, one set of holes is used to bolt the retrofit ring to the drum lugs, the second set of holes is used to mount the one touch tuning system. Elevators are installed in the second set of holes to adjust the height of the one touch tuning system so that the correct distance between the bearing edge of the open end of the drum shell can be set. The retrofit ring can be used on either end of the drum, batter or resonant, or both depending on the needs and budget of the drummer.

Full floating drums generally take the form of a cylindrical "bird cage" having a drum shell enclosed between a series of evenly spaced rods. Full floater drums by design do not have any hardware bolted directly to the drum shell and are popular due to the tonal quality achievable because there is nothing to inhibit resonance and volume. To mount one touch tuning systems to both ends of a drum, a full floating framework is advantageous. On one end of the drum a one touch tuning systems encircles the vertical walls of a flange ring and is connected by elevators to the horizontal surface of the flange ring radially. A plurality of solid or hollow adjustable pull rods attached to the bottom side of the horizontal surface of the edge ring connect a second one touch tuning system. A shell is then inserted into the framework parallel to the pull rods until seated on the bottom side of the edge ring. The adjustable pull rods employ a standard thread and a reverse thread. Turning the pull rod one direction extends the rod, turning the opposite direction shortens it thereby adjusting the one touch tuning system in relation to the open end of the drum shell for optimal tuning range.

Preferred embodiments of the one touch tuning system uses rim rollers which project inward from the one touch tuning system's rotating actuator ring, and provide for free rotation as it turns on the cam ring and exerts force on the inner hoop. The profile of the roller facing the vertical wall of the inner hoop is preferably oblong or elliptical like an egg rather than symmetrical like a car tire. This shape aids in aligning the inner hoop and the rotating actuator to prevent or deter them from coming into contact with each other and binding. The result is smoother operation and more precise adjustment.

The embodiments of the invention in which an exclusive property or privilege is claimed are defined as follows:

1. A full floating framework having a rotation actuated drum tuning system for a musical drum comprising:

a rotation actuated drum tuning system on the top side of the drum, also referred to as the batter head;

a flanged annular ring member having an L cross section having both vertical and horizontal walls, a multiplicity of adjustable pull rods, and a second drum tuning and/or tensioning system on the bottom;

said flanged annular ring member having a plurality of generally evenly spaced holes to attach said tuning system and/or pull rods; said flange ring's vertical wall of the L cross section doubling as a drum shell for the upper tuning system;

the underside of said flanged annular ring member used to enclose a drum shell between one open end of the framework on the bottom;

said pull rods being shorter than the length of the drums shell and connecting the second drum tuning system to the flanged annular ring; and having female threads on both ends;

said pull rods having a standard thread on one end, the other end having a reverse thread;

said adjustable pull rod having a standard mating male stud or bolt on one end and a mating male reverse thread stud or bolt on the other end;

arranged so that clockwise and/or counterclockwise twisting of said adjustable pull rods extend or shorten the overall length of the full floating musical drum framework in order to allow a full range or adjustment when tensioning the drum head on the bottom of the drum;

said framework having a rotation actuated drum tuning system on the bottom end of the drum also know as the resonant head;

said framework providing a means for separate adjustment of the drum's batter and resonant heads.

2. An elevator according to claim 1 used to attach and adjust the vertical height of said one rotation actuated tuning system to the full floating drum framework flange rings; said elevator having two parts, a long hollow nut with external threads, and a standard bolt; said hollow nut having a hex or knurled end for adjustment; said hollow nut threaded into the flange ring; said standard bolt threaded into the Cam Ring of the rotation actuated tuning system; a multiplicity of said hollow nuts threaded into said flange ring; said standard bolt threaded into said one touch drum tuning system; turning the multiplicity of said hollow nuts clockwise or counterclockwise raises or lowers said one touch tuning system in order to align it perpendicular to the bearing edge of the drum's shell; tightening said standard bolt to said hollow nut locks down the system.

3. A retrofit ring having a multiplicity of evenly spaced holes throughout its horizontal surface for attaching and adapting a one touch tuning system toe the lugs of a conventional musical drum;

said retrofit having one set of holes being unthreaded;

said retrofit ring having another set of holes being threaded;

said retrofit ring having evenly spaced scallops or reliefs matching the number of unthreaded holes about its inside diameter; said threaded holes being offset from the unthreaded holes.

4. An elevator according to claim 3 used to attach the rotation actuated tuning system to a musical drum with standard lugs; said elevator having two parts, a long hollow nut with external threads, and a standard bolt; said hollow nut having a hex or knurled end for adjustment; said hollow nut threaded into the flange ring; said standard bolt threaded into the Cam Ring of the rotation actuated tuning system; a multiplicity of said hollow nuts threaded into said flange ring; said standard bolt threaded into said one touch drum tuning system; turning the multiplicity of said hollow nuts clockwise or counterclockwise raises or lowers said one touch tuning system in order to align it perpendicular to the bearing edge of the drum's shell; tightening said standard bolt to said hollow nut locks down the system.

5. An offset rim roller used on the Inner Hoop of the one touch tuning system for musical drum; said rim roller having an offset profile having a different shape on one side than the other; said offset matching the profile of the inner hoop on the one touch tuning system at its horizontal and vertical axis; said offset rim roller aligning said inner hoop and the rotating actuator of said one touch tuning system.

* * * * *